US007481250B2

(12) United States Patent
Ito et al.

(10) Patent No.: US 7,481,250 B2
(45) Date of Patent: Jan. 27, 2009

(54) FABRIC FOR HORIZONTAL BELT FILTER

(75) Inventors: Senri Ito, Tokyo (JP); Ichihiro Kitamura, Tokyo (JP); Kazuyuki Kanda, Tokyo (JP)

(73) Assignee: Nippon Filcon Co. Ltd., Tokyo (JP)

( * ) Notice: Subject to any disclaimer, the term of this patent is extended or adjusted under 35 U.S.C. 154(b) by 291 days.

(21) Appl. No.: 11/102,739

(22) Filed: Apr. 11, 2005

(65) Prior Publication Data

US 2005/0229995 A1 Oct. 20, 2005

(30) Foreign Application Priority Data

Apr. 14, 2004 (JP) ..... 2004-118682

(51) Int. Cl.
*D21F 7/08* (2006.01)
*D03D 3/04* (2006.01)
*D03D 11/00* (2006.01)
*D03D 25/00* (2006.01)

(52) U.S. Cl. ..... 139/383 A; 139/408; 139/413

(58) Field of Classification Search ..... 139/383 A, 139/408, 409, 410, 413
See application file for complete search history.

(56) References Cited

U.S. PATENT DOCUMENTS 5,694,980 A * 12/1997 Quigley ..... 139/383 A
5,713,397 A * 2/1998 Quigley ..... 139/383 A
6,237,644 B1 * 5/2001 Hay et al. ..... 139/383 A
6,413,377 B1 * 7/2002 Wright ..... 139/383 A
6,780,800 B2 * 8/2004 Itoh ..... 442/190
6,810,917 B2 * 11/2004 Stone ..... 139/383 A
2004/0182465 A1 * 9/2004 Ward ..... 139/383 A
2005/0224130 A1 * 10/2005 Takimoto et al. ..... 139/408

* cited by examiner

*Primary Examiner*—Bobby H Muromoto, Jr.
(74) *Attorney, Agent, or Firm*—Rader, Fishman & Grauer, PLLC

(57) ABSTRACT

A fabric for a horizontal belt filter includes a two-layer structure in which an upper-surface-side weft forming an upper-surface-side layer and a running-face-side weft forming a running-face-side layer are woven together by a warp. An upper-surface-side surface of the fabric includes a warp long crimp portion of a warp which passes over four or more continuous upper-surface-side wefts; and a warp latent portion which passes under one to four upper-surface-side wefts. At least a part of the warp latent portion passes under one or two running-face-side wefts to weave together the upper-surface-side layer and the running-face-side layer. The warp long crimp is formed on the upper-surface-side surface, and a weft long crimp is formed on a running-face-side surface. The fabric exhibits a good peeling property of a treated matter and which is superior in a cleaning property, rigidity, running stability, and wear resistance.

5 Claims, 4 Drawing Sheets

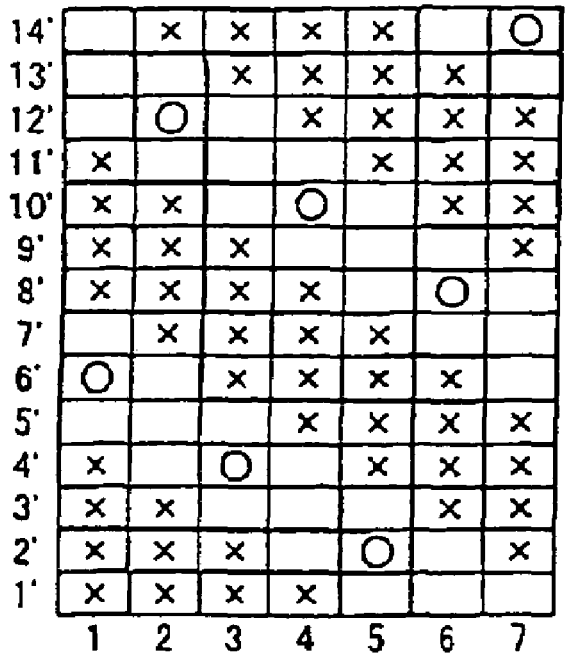

FIG. 1

| | 1 | 2 | 3 | 4 | 5 | 6 | 7 |
|---|---|---|---|---|---|---|---|
| 14' | | × | × | × | × | | ○ |
| 13' | | | × | × | × | × | |
| 12' | | ○ | | × | × | × | × |
| 11' | × | | | | × | × | × |
| 10' | × | × | | ○ | | × | × |
| 9' | × | × | × | | | | × |
| 8' | × | × | × | × | | ○ | |
| 7' | | × | × | × | × | | |
| 6' | ○ | | × | × | × | × | |
| 5' | | | | × | × | × | × |
| 4' | × | | ○ | | × | × | × |
| 3' | × | × | | | | × | × |
| 2' | × | × | × | | ○ | | × |
| 1' | × | × | × | × | | | |

FIG. 2

| | 1 | 2 | 3 | 4 | 5 | 6 | 7 | 8 |
|---|---|---|---|---|---|---|---|---|
| 16' | | × | × | | | × | × | |
| 15' | | × | × | × | ○ | × | × | × |
| 14' | | | × | × | | | × | × |
| 13' | × | ○ | × | × | × | | × | × |
| 12' | × | | | × | × | | | × |
| 11' | × | × | | × | × | × | ○ | × |
| 10' | × | × | | | × | × | | |
| 9' | × | × | × | ○ | × | × | × | |
| 8' | | × | × | | | × | × | |
| 7' | ○ | × | × | × | | × | × | × |
| 6' | | | × | × | | | × | × |
| 5' | × | | × | × | × | ○ | × | × |
| 4' | × | | | × | × | | | × |
| 3' | × | × | ○ | × | × | × | | × |
| 2' | × | × | | | × | × | | |
| 1' | × | × | × | | × | × | × | ○ |

FIG. 3

| | 1 | 2 | 3 | 4 | 5 | 6 |
|---|---|---|---|---|---|---|
| 12' | | × | × | ○ | × | × |
| 11' | × | × | | | × | × |
| 10' | × | × | ○ | × | × | |
| 9' | × | | | × | × | × |
| 8' | × | ○ | × | × | | × |
| 7' | | | × | × | × | × |
| 6' | ○ | × | × | | × | × |
| 5' | | × | × | × | × | |
| 4' | × | × | | × | × | ○ |
| 3' | × | × | × | × | | |
| 2' | × | | × | × | ○ | × |
| 1' | × | × | × | | | × |

FIG. 4

| | 1 | 2 | 3 | 4 | 5 | 6 | 7 |
|---|---|---|---|---|---|---|---|
| 14' | | | × | × | × | × | |
| 13' | × | O | × | × | × | × | × |
| 12' | × | | | | × | × | × |
| 11' | × | × | × | O | × | × | × |
| 10' | × | × | × | | | | × |
| 9' | × | × | × | × | × | O | × |
| 8' | | × | × | × | × | | |
| 7' | O | × | × | × | × | × | × |
| 6' | | | | × | × | × | × |
| 5' | × | × | O | × | × | × | × |
| 4' | × | × | | | | × | × |
| 3' | × | × | × | × | O | × | × |
| 2' | × | × | × | × | | | |
| 1' | × | × | × | × | × | × | O |

FIG. 5

| | 1 | 2 | 3 | 4 | 5 | 6 | 7 | 8 |
|---|---|---|---|---|---|---|---|---|
| 16' | | × | × | × | O | × | × | × |
| 15' | × | | × | × | | × | × | × |
| 14' | × | O | × | × | × | | × | × |
| 13' | × | | × | × | × | × | | × |
| 12' | × | × | | × | × | × | O | × |
| 11' | × | × | × | | × | × | | × |
| 10' | × | × | × | O | × | × | × | |
| 9' | | × | × | | × | × | × | × |
| 8' | O | × | × | × | | × | × | × |
| 7' | | × | × | × | × | | × | × |
| 6' | × | | × | × | × | O | × | × |
| 5' | × | × | | × | × | | × | × |
| 4' | × | × | O | × | × | × | | × |
| 3' | × | × | | × | × | × | × | |
| 2' | × | × | × | | × | × | × | O |
| 1' | × | × | × | × | | × | × | |

FIG. 6

| | 1 | 2 | 3 | 4 | 5 | 6 | 7 | 8 | 9 | 10 | 11 | 12 |
|---|---|---|---|---|---|---|---|---|---|---|---|---|
| 12' | | | × | × | × | × | O | O | × | × | × | × |
| 11' | × | × | × | × | | | | | × | × | × | × |
| 10' | × | × | × | × | O | O | × | × | × | × | × | × |
| 9' | × | × | | | | | × | × | × | × | × | |
| 8' | × | × | O | O | × | × | × | × | × | × | × | × |
| 7' | | | | | × | × | × | × | × | | × | × |
| 6' | O | O | × | × | × | × | × | × | × | × | × | × |
| 5' | | | × | × | × | × | × | | × | × | | |
| 4' | × | × | × | × | × | × | × | × | × | × | O | O |
| 3' | × | × | × | × | × | | × | × | | | | |
| 2' | × | × | × | × | × | × | × | × | O | O | × | × |
| 1' | × | × | × | | × | × | | | | | × | × |

FIG. 7

| | 1 | 2 | 3 | 4 | 5 | 6 | 7 |
|---|---|---|---|---|---|---|---|
| 14' | | | × | × | × | × | ○ |
| 13' | | ○ | × | × | × | × | |
| 12' | × | ○ | | | × | × | × |
| 11' | × | | | ○ | × | × | × |
| 10' | × | × | × | ○ | | | × |
| 9' | × | × | × | | | ○ | × |
| 8' | | × | × | × | × | ○ | |
| 7' | ○ | × | × | × | × | | |
| 6' | ○ | | | × | × | × | × |
| 5' | | | ○ | × | × | × | × |
| 4' | × | × | ○ | | | × | × |
| 3' | × | × | | | ○ | × | × |
| 2' | × | × | × | × | ○ | | |
| 1' | × | × | × | × | | | ○ |

FIG. 8

| | 1 | 2 | 3 | 4 | 5 | 6 | 7 | 8 |
|---|---|---|---|---|---|---|---|---|
| 16' | | × | × | × | ○ | × | × | |
| 15' | | | × | × | ○ | × | × | × |
| 14' | × | ○ | × | × | | | × | × |
| 13' | × | ○ | × | × | × | | | × |
| 12' | × | | | × | × | × | ○ | × |
| 11' | × | × | | | × | × | ○ | × |
| 10' | × | × | × | ○ | × | × | | |
| 9' | | × | × | ○ | × | × | × | |
| 8' | ○ | × | × | | | × | × | × |
| 7' | ○ | × | × | × | | | × | × |
| 6' | | | × | × | × | ○ | × | × |
| 5' | × | | | × | × | ○ | × | × |
| 4' | × | × | ○ | × | × | | | × |
| 3' | × | × | ○ | × | × | × | | |
| 2' | × | × | | | × | × | × | ○ |
| 1' | × | × | × | | | × | × | ○ |

FIG. 9

| | 1 | 2 | 3 | 4 | 5 | 6 | 7 |
|---|---|---|---|---|---|---|---|
| 14' | | | × | × | × | × | |
| 13' | | ○ | × | × | × | × | × |
| 12' | × | | | | × | × | × |
| 11' | × | × | | ○ | × | × | × |
| 10' | × | × | × | | | | × |
| 9' | × | × | × | × | | ○ | × |
| 8' | | × | × | × | × | | |
| 7' | ○ | × | × | × | × | × | |
| 6' | | | | × | × | × | × |
| 5' | × | | ○ | × | × | × | × |
| 4' | × | × | | | | × | × |
| 3' | × | × | × | | ○ | × | × |
| 2' | × | × | × | × | | | |
| 1' | × | × | × | × | × | | ○ |

FIG. 10

| | 1 | 2 | 3 | 4 | 5 | 6 | 7 | 8 |
|---|---|---|---|---|---|---|---|---|
| 16' | | × | × | | | × | × | |
| 15' | ○ | × | × | × | ○ | × | × | × |
| 14' | | | × | × | | | × | × |
| 13' | × | | × | × | × | ○ | × | × |
| 12' | × | | | × | × | | | × |
| 11' | × | × | ○ | × | × | × | ○ | × |
| 10' | × | × | | | × | × | | |
| 9' | × | × | × | | × | × | × | ○ |
| 8' | | × | × | | | × | × | |
| 7' | ○ | × | × | × | ○ | × | × | × |
| 6' | | | × | × | | | × | × |
| 5' | × | ○ | × | × | × | | × | × |
| 4' | × | | | × | × | | | × |
| 3' | × | × | ○ | × | × | × | ○ | × |
| 2' | × | × | | | × | × | | |
| 1' | × | × | × | ○ | × | × | × | |

FIG. 11

| | 1 | 2 | 3 | 4 | 5 | 6 | 7 |
|---|---|---|---|---|---|---|---|
| 7' | | × | ○ | × | | × | × |
| 6' | ○ | × | | × | × | | × |
| 5' | | × | × | | × | ○ | × |
| 4' | × | | × | ○ | × | | × |
| 3' | × | ○ | × | | × | × | |
| 2' | × | | × | × | | × | ○ |
| 1' | × | × | | × | ○ | × | |

FIG. 12

| | 1 | 2 | 3 | 4 | 5 | 6 | 7 | 8 |
|---|---|---|---|---|---|---|---|---|
| 8' | | × | × | ○ | × | × | | × |
| 7' | ○ | × | × | | × | | × | × |
| 6' | | × | | × | × | ○ | × | × |
| 5' | × | × | ○ | × | × | | × | |
| 4' | × | × | | × | | × | × | ○ |
| 3' | × | | × | × | ○ | × | × | |
| 2' | × | ○ | × | × | | × | | × |
| 1' | × | | × | | × | × | ○ | × |

FABRIC FOR HORIZONTAL BELT FILTER

TECHNICAL FIELD OF THE INVENTION

The present invention relates to a fabric for a horizontal belt filter, for use in dewatering, filtering, cleaning, condensing, or refining a solid-liquid slurry of metal powder, organic acid, ceramic, resin, micro powder, metal oxide, gypsum, dye, or chemical fiber material in fields of chemical industry, pharmaceutical industry, food industry, mineral dressing and the like.

BACKGROUND ART

A horizontal belt filter is a device which dewaters, filters, cleans, condenses, and refines a solid-liquid slurry. In general, the device rotates an endless fabric wound around a plurality of rollers under a certain tension, and efficiently separates solid/liquid by a vacuum suction device disposed under a portion in which the fabric runs horizontally.

As physical properties demanded from the fabric for the horizontal belt filter, a sufficient solid-liquid separating property, that is, a capturing property sufficient for obtaining a treated matter on the surface of the fabric, and a water filtering property for obtaining a filtered liquid through the fabric are required. Additionally, a peeling property of the treated matter from the fabric, required in sampling the treated matter on the fabric, a cleaning property for removing a stuck residue, rigidity for supporting the treated matter on the fabric, rigidity or running stability for preventing elongation or deformation by tension, meandering caused by a dimensional change or the like, wear resistance to wear generated by friction with the rollers and the like are required.

In Japanese Patent Application Laid-Open No. 2003-275514, invention concerning the fabric for the horizontal belt filter has been laid open, in which permeability and hanging tension are limited. It is described that the fabric has a sufficient solid-liquid separating property, and rigidity. Preferable examples of a fabric texture include a single-layer or multilayered fabric of plain weave, twill weave, or satin weave. In the examples, it is described that the hanging tension and permeability are set to be constant, and accordingly a solid-liquid separating performance is enhanced. However, needless to say, a sufficient solid-liquid separating property and rigidity cannot be obtained in this case.

To obtain the water filtering property, capturing property, rigidity, cleaning property and the like required for the fabric for the horizontal belt filter, it is insufficient to limit the water filtering property or the hanging tension only, and the fabric texture is important. For example, to sufficiently capture the treated matter on the surface of the fabric, the surface needs to have a dense structure, and the texture needs to be superior in the water filtering property. Additionally, the fabric needs to be structured in such a manner that any residue is not left in meshes in a case where the treated matter on the fabric is scratched off the fabric with a scraper or the like, and the fabric has to be superior in rigidity in order to avoid creases or folds, or satisfy running stability or the like. As described above, the fabric which fully satisfies all performances required for the fabric for the horizontal belt filter has not been realized.

SUMMARY OF THE INVENTION

In view of the above-described problem, according to the present invention, there is provided a fabric for a horizontal belt which dewaters, filters, cleans, condenses, or refines a solid-liquid slurry of metal powder, organic acid, ceramic, resin, micro powder, metal oxide, gypsum, dye, or chemical fiber material using the horizontal belt fabric having a two-layer structure in fields of chemical industry, pharmaceutical industry, food industry, mineral dressing and the like and which is superior in solid-liquid separating property, peeling property of a treated matter, cleaning property, rigidity, running stability, and resistance to wear. The fabric is constituted of two-layer structure fabric in which an upper-surface-side weft and a running-face-side weft are stacked, the surface of the fabric on the upper surface side is constituted of a warp long crimp portion and a warp latent portion, two layers are woven together under the running-face-side weft in at least a part of the warp latent portion, the warp long crimp is formed on the surface on the upper surface side, and a weft long crimp is formed on the surface on the running face side.

The present invention relates to a fabric for a horizontal belt filter having a two-layer structure, in which an upper-surface-side weft forming an upper-surface-side layer and a running-face-side weft forming a running-face-side layer are woven together by a warp. A warp includes a warp long crimp portion and a warp latent portion. The warp long crimp portion passes over four or more continuous upper-surface-side wefts. The warp latent portion passes under one to four upper-surface-side wefts. At least the part of the warp latent portion passes under one or two running-face-side wefts to weave together the upper-surface-side layer and the running-face-side layer. The warp long crimp is formed on the upper-surface-side surface, and a weft long crimp is formed on the running-face-side surface.

The warp latent portion may pass between the upper-surface-side layer and the running-face-side layer, subsequently under one or two running-face-side wefts, and subsequently between the upper-surface-side layer and the running-face-side layer.

The fabric for the horizontal belt filter may include two different warp latent portions. In this case, one of the two warp latent potions may pass between the upper-surface-side layer and the running-face-side layer, subsequently under one or two running-face-side wefts, and subsequently between the upper-surface-side layer and the running-face-side layer, whereas the other warp latent portion may pass between one to four upper-surface-side wefts and the running-face-side wefts.

A ratio of the arrangement number of the upper-surface-side wefts to that of the running-face-side wefts may be in a range of 1:1 to 2:1. The upper-surface-side surface of the fabric may be a warp rich texture in which warps appear more than wefts, and the running-face-side surface may be a weft rich texture in which wefts appear more than warps.

The fabric for a horizontal belt filter of this invention is capable of efficiently dewatering, filtering, cleaning, condensing, or refining a solid-liquid slurry of metal powder, organic acid, ceramic, resin, micro powder, metal oxide, gypsum, dye, or chemical fiber material in fields of chemical industry, pharmaceutical industry, food industry, mineral dressing and the like and which satisfies a sufficient solid-liquid separating property, capturing property, water filtering property, peeling property, cleaning property, rigidity, running stability, and resistance to wear required for the fabric for the horizontal belt filter.

BRIEF DESCRIPTION OF THE DRAWINGS

FIG. 1 is a design diagram showing a complete texture (a minimum repeating unit) of Example 1 of the present invention.

FIG. 2 is a design diagram showing a complete texture of Example 2 of the present invention.

FIG. 3 is a design diagram showing a complete texture of Example 3 of the present invention.

FIG. 4 is a design diagram showing a complete texture of Example 4 of the present invention.

FIG. 5 is a design diagram showing a complete texture of Example 5 of the present invention.

FIG. 6 is a design diagram showing a complete texture of Example 6 of the present invention.

FIG. 7 is a design diagram showing a complete texture of Example 7 of the present invention.

FIG. 8 is a design diagram showing a complete texture of Example 8 of the present invention.

FIG. 9 is a design diagram showing a complete texture of Example 9 of the present invention.

FIG. 10 is a design diagram showing a complete texture of Example 10 of the present invention.

FIG. 11 is a design diagram showing a complete texture of Example 11 of the present invention.

FIG. 12 is a design diagram showing a complete texture of Example 12 of the present invention.

DETAILED DESCRIPTION OF THE INVENTION

A fabric for a horizontal belt filter of the present invention dewaters, filters, cleans, condenses, and refines a solid-liquid slurry of a chemical fiber material, and produces a superior effect in solid-liquid separating property, peeling property of a treated matter, cleaning property, rigidity, running stability, resistance to wear and the like.

The fabric for the horizontal belt filter of the present invention is a fabric having a two-layer structure, the surface on an upper surface side has a warp rich structure which is comparatively dense and in which many warps appear, and the surface on a running face side has a weft rich structure in which many running-face-side wefts appear and which is superior in resistance to wear. By the two-layer structure, a superior water filtering property can be secured even in the fabric which forms the comparatively dense upper-surface-side surface, because a water filtering space is formed from an upper-surface-side layer toward a running-face-side layer. Moreover, since the number of fabric constituting yarns increases as compared with a single-layer structure, rigidity is improved. Since the upper-surface-side surface includes warps appearing more than wefts to form a uniform surface, residues are not easily left in meshes of the fabric even if the treated matter on the fabric surface are scratched off.

In the fabric of the present invention, an upper-surface-side weft forming the upper-surface-side layer, and a running-face-side weft forming a running-face-side layer are vertically stacked, and they are woven together by warps to form the two-layer structure. An arrangement number ratio of the upper-surface-side wefts may be equal to that of the running-face-side wefts, but the ratio may be 2:1, 3:1, 3:2 or the like in such a manner that the surface is dense, and the running face is coarse. When the surface is dense, a capturing property of a treated matter is enhanced. When the running face is coarse, a dewatering space is secured, and both the capturing property and the dewatering property can be preferably satisfied.

A texture of the upper surface side is formed by warp long crimp portions of warps that pass over four or more continuous upper-surface-side wefts in a repeating unit and upper-surface-side weft crimp portions in which the warp latent portions pass under one to four upper-surface-side wefts in a repeating unit and do not appear on the upper-surface-side surface. A "long crimp" of a warp on an upper surface of a fabric according to the present invention is formed when a warp passes over two or more wefts after the warp passes under a weft and before the warp passes under another weft. A long crimp of a warp is obviously longer in length than a crimp of which a warp passes over one weft after the warp passes under a weft and before the warp passes under another weft. Likewise, a "long crimp" of a weft on a running surface of a fabric according to the present invention is formed when a weft passes under two or more warps after the weft passes over a warp and before the weft passes over another warp.

At least a part of the warp latent portion passes under one or two running-face-side wefts to weave together two layers in a repeating unit. On the upper-surface-side surface, the warps appear more than the wefts on the surface, and a smooth surface is formed by the warps. In the present invention, a warp long crimp may have a texture passing above four or more upper-surface-side wefts in a repeating unit, preferably a texture passing above about four to six upper-surface-side wefts. The warp long crimp may be long by seven or more upper-surface-side wefts in a repeating unit, but when the crimp is excessively long, the yarns float, or shift to the right/left, and a problem is caused in a rigidity aspect. Therefore, the length of the crimp needs to be appropriately selected in accordance with weavability, use purpose and the like.

The warp latent portion may be under one to four upper-surface-side wefts in a repeating unit, and may be disposed between the upper-surface-side weft and the running-face-side weft or under the running-face-side weft. At least a part of the warp latent portion may be disposed under one or two continuous running-face-side wefts to weave together two layers. That is, the upper-surface-side surface may include a texture having a portion where a warp passes over four or more upper-surface-side wefts in a complete texture to form a warp long crimp on the upper-surface-side surface; and a portion where a warp latent portion passes under one to four upper-surface-side wefts. In a complete texture of the warps, one or two or more kinds of warp latent portions may exist. For example, one latent portion may have a structure of passing under the running-face-side weft, and the other latent portion may have a structure disposed between the upper-surface-side wefts and the running-face-side wefts. Needless to say, both warp presence portions may be structured in such a manner as to have portions passing under the running-face-side weft.

In the present invention, a warp rich texture in which more warp portions appear than weft portions is preferably disposed on the upper-surface-side surface. When the warp latent portion is excessively long, many wefts are arranged on the upper-surface-side surface, and a peeling property of the treated matter or difficulty in sticking the residue and the like tend to drop. Therefore, the warp latent portion preferably forms a texture which includes one to four upper-surface-side wefts, and a part of the warp latent portion passes under one or two running-face-side weft(s) in a repeating unit to avoid the warp latent portion from being lengthened.

Moreover, the running-face-side surface is formed into a weft rich texture in which the warps form a portion passing under one or two continuous running-face-side wefts, the running-face-side wefts form a comparatively long running-face-side weft crimp on the running-face-side surface. When the long weft crimp is formed on the running-face-side surface, the fabric is superior in resistance to wear.

The yarns for use in the present invention may be selected in accordance with functions of the respective yarns on the fabric. For example, in addition to monofilaments, multi filaments, spun yarns, worked yarns generally referred to as textured yarns, bulky yarns, and stretch yarns subjected to crimp working or bulk working, or yarns which are intertwined or combined otherwise are usable. A sectional shape of the yarn is not limited to a circular shape, and short yarns such as tetragonal and star-shaped yarns, elliptical yarns, and hollow yarns are usable. A yarn material can be freely selected, and polyester, nylon, polyphenylene sulfide, polyvinyliden fluoride, polypro, aramid, polyether ether ketone, polyethylene naphthalate, polytetrafluoro ethylene, cotton, wool, metal and the like are usable. Needless to say, yarns of copolymer or the materials blended with or containing various materials in accordance with the purpose may be used.

As for the fabric for the horizontal belt filter, in general, polyester monofilaments which are superior in rigidity and dimensional stability are preferably used, and the fabric can be appropriately selected in accordance with properties, weavability and the like of the fabric. The polyester monofilaments and nylon monofilaments are alternately arranged as the case may be, and combined weaving is preferable because the wear resistance can be enhanced while enhancing the rigidity. Polyphenylene sulfide having heat resistance or the like may be used in an atmosphere at high temperature.

Linear diameters may be selected in accordance with the application or aptitude, linear diameters of the upper-surface-side wefts forming the comparatively dense surface may be reduced, the linear diameter of the running-face-side weft may be set to be larger than that of the upper-surface-side weft as a wear resistance measure, and the linear diameter is appropriately usable.

EXAMPLES

A mode for carrying out the present invention will be described in accordance with examples with reference to the drawings.

FIGS. 1 to 12 are design diagrams showing complete textures of the examples of the present invention. A single-warp and double-weft fabric is shown in which upper-surface-side and running-face-side wefts are vertically stacked, arranged, and intertwined by a warp. The complete texture indicates a minimum repeating unit of a fabric texture, upper/lower and right/left complete textures are connected to one another, and a whole fabric texture is formed.

In the design diagram, warps are denoted with Arabic numerals such as 1, 2, 3. Wefts are denoted with Arabic numerals with primes such as 2', 4', 6'. Upper-surface-side wefts are vertically superimposed over running-face-side wefts in parallel. A mark x indicates that a warp passes over an upper-surface-side weft and appears on the upper-surface-side surface. A mark ○ indicates that a warp passes under a running-face-side weft. In the examples of the present invention, in the design diagrams, the upper-surface-side and running-face-side wefts are vertically superimposed and arranged for the sake of convenience, but the wefts are sometimes shifted and arranged in an actual fabric.

Next, the mode for carrying out the present invention will be described in accordance with examples with reference to the drawings.

Example 1

A design diagram of FIG. 1 shows a complete texture of Example 1 of the present invention, and the texture includes seven warps, 14 upper-surface-side wefts, and seven running-face-side wefts. The upper-surface-side wefts and the running-face-side wefts are arranged at a ratio of 2:1. A warp texture passes above four continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above four continuous upper-surface-side wefts, and next passes between three continuous upper-surface-side wefts and the running-face-side layer. The upper-surface-side surface has a texture in which a warp long crimp for four upper-surface-side wefts, and a warp latent portion for three upper-surface-side wefts are repeated. In the running-face-side layer, a texture is formed in which the running-face-side weft passes above one warp, and next passes under six continuous warps to form a long crimp of the running-face-side weft on the running-face-side surface.

In a plain-weave single-layer fabric described in an example of Japanese Patent Application Laid-Open No. 2003-275514, a dense surface, superior water filtering property, wear resistance, and rigidity as in the present example cannot be obtained. In a plain-weave texture, since one warp and one weft alternately form an intersection, the number of shooting yarns, that is, yarn density cannot be increased much. Therefore, a dense surface superior in capturing property cannot be formed. When linear density is enhanced in order to enhance a capturing property, a water filtering property cannot be obtained. To obtain both the capturing property of the treated matter by the dense surface and the superior water filtering property, a two-layer structure is constituted as in the present invention, and the structure may be include a texture in which a dense surface including a warp long crimp and a warp latent portion can be formed, and a texture in which many running-face-side wefts are arranged.

In this texture, a smooth surface is formed by the warps on the upper-surface-side surface, the surface is comparatively dense, and a capturing property of a treated matter is superior. Since the fabric surface is formed by the warp crimp along a fabric running direction, residue of the treated matter does not easily stick, and the fabric is superior in a peeling property of the treated matter, and a cleaning property.

Example 2

A design diagram of FIG. 2 shows a complete texture of Example 2 of the present invention, and the texture includes eight warps, 16 upper-surface-side wefts, and eight running-face-side wefts. The upper-surface-side wefts and the running-face-side wefts are arranged at a ratio of 2:1. A warp texture passes above five continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above five continuous upper-surface-side wefts, and next passes between three continuous upper-surface-side wefts and the running-face-side layer. The upper-surface-side surface has a 5/3 texture in which a warp long crimp for five upper-surface-side wefts, and a warp latent portion for three upper-surface-side wefts are repeated. In the running-face-side layer, a texture is formed in which the running-face-side weft passes above one warp, and next passes under seven continuous warps to form a long crimp of the running-face-side weft on the running-face-side surface.

In the texture of the present example, a comparatively dense, and smooth surface is formed on the upper-surface-side surface, and a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 3

A design diagram of FIG. 3 shows a complete texture of Example 3 of the present invention, and the texture includes six warps, 12 upper-surface-side wefts, and six running-face-side wefts. The upper-surface-side wefts and the running-face-side wefts are arranged at a ratio of 2:1. A warp texture passes above four continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above four continuous upper-surface-side wefts, and next passes between one upper-surface-side weft and the running-face-side layer. The upper-surface-side surface has a 4/3 to 4/1 texture in which a warp long crimp for four upper-surface-side wefts, a warp latent portion for three upper-surface-side wefts, a warp long crimp for four upper-surface-side wefts, and a warp latent portion for one upper-surface-side weft are repeated. In the running-face-side layer, a texture is formed in which the running-face-side weft passes above one warp, and next passes under five continuous warps to form a long crimp of the running-face-side weft on the running-face-side surface. The warp latent portions including different lengths may be disposed in the warp complete texture as in the present example, and, needless to say, warp long crimps including different lengths may be disposed.

In the texture of the present example, since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 4

A design diagram of FIG. 4 shows a complete texture of Example 4 of the present invention, and the texture includes seven warps, 14 upper-surface-side wefts, and seven running-face-side wefts. The upper-surface-side wefts and the running-face-side wefts are arranged at a ratio of 2:1. A warp texture passes above five continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above five continuous upper-surface-side wefts, and next passes between one upper-surface-side weft and the running-face-side layer. The upper-surface-side surface has a 5/3 to 5/1 texture in which a warp long crimp for five upper-surface-side wefts, a warp latent portion for three upper-surface-side wefts, a warp long crimp for five upper-surface-side wefts, and a warp latent portion for one upper-surface-side weft are repeated. In the running-face-side layer, a texture is formed in which the running-face-side weft passes above one warp, and next passes under six continuous warps to form a long crimp of the running-face-side weft on the running-face-side surface.

In the texture of the present example, since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 5

A design diagram of FIG. 5 shows a complete texture of Example 5 of the present invention, and the texture includes eight warps, 16 upper-surface-side wefts, and eight running-face-side wefts. The upper-surface-side wefts and the running-face-side wefts are arranged at a ratio of 2:1. A warp texture passes above six continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above six continuous upper-surface-side wefts, and next passes between one upper-surface-side weft and the running-face-side layer. The upper-surface-side surface has a 6/3 to 6/1 texture in which a warp long crimp for six upper-surface-side wefts, a warp latent portion for three upper-surface-side wefts, a warp long crimp for six upper-surface-side wefts, and a warp latent portion for one upper-surface-side weft are repeated. In the running-face-side layer, a texture is formed in which the running-face-side weft passes above one warp, and next passes under seven continuous warps to form a long crimp of the running-face-side weft on the running-face-side surface.

In the texture of the present example, since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 6

A design diagram of FIG. 6 shows a complete texture of Example 6 of the present invention, and the texture includes 12 warps, 12 upper-surface-side wefts, and six running-face-side wefts. The upper-surface-side wefts and the running-face-side wefts are arranged at a ratio of 2:1. A warp texture is the same as that of Example 3. The texture passes above four continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above four continuous upper-surface-side wefts, and next passes between one upper-surface-side weft and the running-face-side layer. The upper-surface-side surface has a 4/3 to 4/1 texture in which a warp long crimp for four upper-surface-side wefts, a warp latent portion for three upper-surface-side wefts, a warp long crimp for four upper-surface-side wefts, and a warp latent portion for one upper-surface-side weft are repeated. A characteristic of the present example is that two adjacent warps have the same texture. Therefore, a long crimp which is long in a transverse direction can be formed. That is, the long crimp for five warps is formed on the running-face-side surface in Example 3, but a long crimp for ten warps can be formed on the running-face-side surface. In this texture, a wear resistance is enhanced. Since one weft is woven by two adjacent warps, rigidity is also superior.

In the texture of the present example, since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 7

A design diagram of FIG. 7 shows a complete texture of Example 7 of the present invention, and the texture includes seven warps, 14 upper-surface-side wefts, and 14 running-face-side wefts. The upper-surface-side wefts and the running-face-side wefts are arranged at a ratio of 1:1. A warp texture passes above four continuous upper-surface-side wefts, next passes between one upper-surface-side weft and a running-face-side layer, and next passes under two running-face-side wefts to weave together an upper-surface-side layer and the running-face-side layer. The texture next passes between one upper-surface-side weft and the running-face-side layer, next passes above four continuous upper-surface-side wefts, and next passes between two continuous upper-surface-side weft and the running-face-side layer. The upper-surface-side surface has a 4/4 to 4/2 texture in which a warp long crimp for four upper-surface-side wefts, a warp latent portion for four upper-surface-side wefts, a warp long crimp for four upper-surface-side wefts, and a warp latent portion for two upper-surface-side wefts are repeated. In the running-face-side layer, a texture is formed in which the running-face-side weft passes above one warp, and next passes under six continuous warps to form a long crimp of the running-face-side weft on the running-face-side surface.

When an arrangement ratio of the upper-surface-side wefts is set to be equal to that of the running-face-side wefts as in the present example, superior rigidity is obtained. Since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 8

A design diagram of FIG. 8 shows a complete texture of Example 8 of the present invention, and the texture includes eight warps, 16 upper-surface-side wefts, and 16 running-face-side wefts. The upper-surface-side wefts and the running-face-side wefts are arranged at a ratio of 1:1. A warp texture passes above five continuous upper-surface-side wefts, next passes between one upper-surface-side weft and a running-face-side layer, and next passes under two continuous running-face-side wefts to weave together an upper-surface-side layer and the running-face-side layer. The texture next passes between one upper-surface-side weft and the running-face-side layer, next passes above five continuous upper-surface-side wefts, and next passes between two continuous upper-surface-side wefis and the running-face-side layer. The upper-surface-side surface has a 5/4 to 5/2 texture in which a warp long crimp for five upper-surface-side wefts, a warp latent portion for four upper-surface-side wefts, a warp long crimp for five upper-surface-side wefts, and a warp latent portion for two upper-surface-side wefts are repeated. In the running-face-side layer, a texture is formed in which the running-face-side weft passes above one warp, and next passes under seven continuous warps to form a long crimp of the running-face-side weft on the running-face-side surface.

When an arrangement ratio of the upper-surface-side wefts is set to be equal to that of the running-face-side wefts as in the present example, superior rigidity is obtained. Since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 9

A design diagram of FIG. 9 shows a complete texture of Example 9 of the present invention, and the texture includes seven warps, 14 upper-surface-side wefts, and seven running-face-side wefts. The upper-surface-side wefts and the running-face-side wefts are arranged at a ratio of 2:1. A warp texture passes above five continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above four continuous upper-surface-side wefts, and next passes between two continuous upper-surface-side wefts and the running-face-side layer. The upper-surface-side surface has a 5/3 to 4/2 texture in which a warp long crimp for five upper-surface-side wefts, a warp latent portion for three upper-surface-side wefts, a warp long crimp for four upper-surface-side wefts, and a warp latent portion for two upper-surface-side wefts are repeated. The warp long crimps and warp latent portions having different lengths may exist in the complete texture of one warp in this manner. In the running-face-side layer, a texture is formed in which the running-face-side weft passes above one warp, and next passes under six continuous warps to form a long crimp of the running-face-side weft on the running-face-side surface.

When an arrangement ratio of the upper-surface-side wefts is set to be equal to that of the running-face-side wefts as in the present example, superior rigidity is obtained. Since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 10

A design diagram of FIG. 10 shows a complete texture of Example 10 of the present invention, and the texture includes eight warps, 16 upper-surface-side wefts, and eight running-face-side wefts. The upper-surface-side wefts and the running-face-side wefts are arranged at a ratio of 2:1. In a warp texture, two textures exist. One texture passes above five continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer, next passes above five continuous upper-surface-side wefts, and next passes between one upper-surface-side weft and the running-face-side layer, next passes under one running-face-side weft to weave together the upper-surface-side layer and the running-face-side layer, and then passes between one upper-surface-side weft and the running-face-side layer. The other texture passes above five upper-surface-side wefts, next passes between one upper-surface-side weft and the running-face-side layer, next passes under one running-face-side weft to weave together the upper-surface-side layer and the running-face-side layer, next passes between one upper-surface-side weft and the running-face-side layer, next passes above five continuous upper-surface-side wefts, and next passes between three continuous upper-surface-side wefts and the running-face-side layer. Accordingly, the upper-surface-side surface has a 5/3 texture in which a warp long crimp for five upper-surface-side wefts, and a warp latent portion for three upper-surface-side wefts are repeated. When the upper-surface-side surface has the warp long crimp and warp latent portion, the texture may includes a complete texture of a plurality of types of warps. In the running-face-side layer, a texture is formed in which the running-face-side weft passes above one warp, and next passes under seven continuous warps to form a long crimp of the running-face-side weft on the running-face-side surface. Another texture is formed in which the running-face-side weft passes above one warp, next passes under three continuous warps, next passes above one warp, and next passes under three continuous warps to form a long crimp of the running-face-side weft on the running-face-side surface.

When an arrangement ratio of the upper-surface-side wefts is set to be equal to that of the running-face-side wefts as in the present example, superior rigidity is obtained. Since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 11

A design diagram of FIG. 11 shows a complete texture of Example 11 of the present invention, and the texture includes seven warps, seven upper-surface-side wefts, and seven running-face-side wefts. The upper-surface-side wefts and the running-face-side wefts are arranged at a ratio of 1:1. A warp texture passes above four continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer. In the upper-surface-side surface, a 4/3 texture is formed by a warp long crimp for four upper-surface-side wefts, and a warp latent portion for three upper-surface-side wefts. In Examples 1 to 10, two warp long crimps and two warp latent portions exist in each complete texture of one warp, but the texture may be constituted of one warp long crimp and one warp latent portion as in the present example. When one or more warp long crimps and warp latent portions exist in the complete texture of the warp, combination, length and the like can be appropriately selected, and there are various variations.

when an arrangement ratio of the upper-surface-side wefts is set to be equal to that of the running-face-side wefts as in the present example, superior rigidity is obtained. Since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

Example 12

A design diagram of FIG. 12 shows a complete texture of Example 12 of the present invention, and the texture includes eight warps, eight upper-surface-side wefts, and eight running-face-side wefts. The upper-surface-side wefts and the running-face-side wefts are arranged at a ratio of 1:1. A warp texture passes above five continuous upper-surface-side wefts, next passes between one upper-surface-side weft and a running-face-side layer, and next passes under one running-face-side weft to weave together an upper-surface-side layer and the running-face-side layer. The texture next passes between one upper-surface-side weft and the running-face-side layer. In the upper-surface-side surface, a 5/3 texture is formed by a warp long crimp for five upper-surface-side wefts, and a warp latent portion for three upper-surface-side wefts. In the present example, the texture is constituted of one warp long crimp, and one warp latent portion in the same manner as in Example 11.

When an arrangement ratio of the upper-surface-side wefts is set to be equal to that of the running-face-side wefts as in the present example, superior rigidity is obtained. Since a comparatively dense, and smooth surface is formed on the upper-surface-side surface, a capturing property of a treated matter is superior. Since the fabric surface is formed by the warp crimp along a fabric running direction, residue of the treated matter does not easily stick, and a peeling property of the treated matter, and a cleaning property of the fabric are also superior. Moreover, the upper-surface-side surface is dense, but a water filtering space connecting an upper-surface-side layer to a running-face-side layer is formed to constitute a two-layer structure, and therefore the water filtering property and wear resistance of the fabric are satisfactory.

A fabric for a horizontal belt filter of the present invention is used in dewatering, filtering, cleaning, or condensing a solid-liquid slurry in fields of chemical industry, mineral dressing, food industry and the like.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2004-118682 filed Apr. 14, 2004 including specification, drawings and claims is incorporated herein by reference in its entirety.

What is claimed is:

1. A fabric for a horizontal belt filter, comprising a two-layer structure wherein upper-surface-side wefts form an upper-surface-side layer having an upper-surface-side surface and a running-face-side wefts form a running-face-side layer having a running-face-side surface, the upper-surface-side wefts and the running-face-side wefts are woven together by warps;

wherein each of warps comprises a warp long crimp portion and a warp latent portion;

the warp long crimp portion passes over four or more continuous upper-surface-side wefts in a complete texture;

the warp latent portion passes under one to four upper-surface-side wefts, wherein at least a part of the warp latent portion passes under one or two running-face-side wefts in the complete texture to weave together the upper-surface-side layer and the running-face-side layer;

the upper-face-side surface comprises the warp long crimp portions and the upper-surface-side wefts which pass over the warp latent portions; and a weft long crimp is formed on the running-face-side surface.

2. The fabric for the horizontal belt filter according to claim 1, wherein the first warp latent portion passes between the upper-surface-side layer and the running-face-side layer, subsequently under one or two running-face-side wefts in the complete texture, and subsequently between the upper-surface-side layer and the running-face-side layer.

3. The fabric for the horizontal belt filter according to claim 1, wherein a first warp latent portion passes, in the complete texture, between the upper-surface-side layer and the running-face-side layer, subsequently under one or two running-face-side wefts, and subsequently between the upper-surface-side layer and the running-face-side layer; and a second warp latent portion passes between one to four upper-surface-side wefts and the running-face-side wefts.

4. The fabric for the horizontal belt filter according to claim 1, wherein a ratio of the arrangement number of the upper-surface-side wefts to that of the running-face-side wefts is in a range of 1:1 to 2:1.

5. The fabric for the horizontal belt filter according to claim 1, wherein the upper-surface-side surface comprises a warp rich texture, and the running-face-side surface comprises a weft rich texture.

* * * * *